US007743727B2

(12) United States Patent
Shekalim

(10) Patent No.: US 7,743,727 B2
(45) Date of Patent: Jun. 29, 2010

(54) STENT COATING APPARATUS AND METHOD

(75) Inventor: Avraham Shekalim, Nesher (IL)

(73) Assignee: Boston Scientific Scimed, Inc., Maple Grove, MN (US)

( * ) Notice: Subject to any disclaimer, the term of this patent is extended or adjusted under 35 U.S.C. 154(b) by 1141 days.

(21) Appl. No.: 11/347,559

(22) Filed: Feb. 3, 2006

(65) Prior Publication Data

US 2006/0233942 A1 Oct. 19, 2006

Related U.S. Application Data

(63) Continuation of application No. PCT/IL2004/000720, filed on Aug. 4, 2004.

(60) Provisional application No. 60/491,977, filed on Aug. 4, 2003.

(51) Int. Cl.

| | |
|---|---|
| ***B05B 7/00*** | (2006.01) |
| ***B05B 3/00*** | (2006.01) |
| ***B05C 11/00*** | (2006.01) |
| ***B41J 2/045*** | (2006.01) |

(52) U.S. Cl. ..... 118/300; 118/323; 118/669; 118/692; 118/712; 347/86; 347/68

(58) Field of Classification Search ..... 118/321, 118/323, 300, 668, 669, 712, 713, 692; 427/2.24, 427/2.1, 2.25, 2.28, 2.3, 424, 427.1, 427.2, 427/427.3; 347/36–87; 222/63, 153, 13, 222/327, 333, 390; 604/154

See application file for complete search history.

(56) References Cited

U.S. PATENT DOCUMENTS

| | | | | |
|---|---|---|---|---|
| 3,802,380 A * | 4/1974 | Ford et al. | ..... | 118/679 |
| 4,842,887 A * | 6/1989 | Bolte | ..... | 427/10 |
| 5,812,165 A * | 9/1998 | Boyd et al. | ..... | 347/87 |
| 5,871,436 A | 2/1999 | Eury | | |
| 5,891,507 A | 4/1999 | Jayaraman | | |
| 5,922,393 A | 7/1999 | Jayaraman | | |
| 6,001,311 A | 12/1999 | Brennan | | |
| 6,106,454 A | 8/2000 | Berg et al. | | |
| 6,109,740 A * | 8/2000 | Namekawa et al. | ..... | 347/85 |

(Continued)

OTHER PUBLICATIONS

Cooley et al., "Applications of Ink-Jet Printing Technology to BioMEMS and Microfluidic Systems", SPIE Conference on Microfluidics and BioMEMS, Oct. 2001.

*Primary Examiner*—Yewebdar T Tadesse
(74) *Attorney, Agent, or Firm*—Vidas, Arrett & Steinkraus P.A.

(57) ABSTRACT

A coating system for coating a stent with a medication, the stent being mounted on a balloon on a catheter, the system having an applicator device including a fluid ejection nozzle, a reservoir and a pressure wave actuating arrangement. The nozzle has an opening configured for dispensing the medication on to the stent. The reservoir is in fluid communication with the nozzle. The nozzle and the reservoir are configured for generating a negative pressure for preventing leakage of the medication via the opening. The pressure wave actuating arrangement is configured for generating a pressure wave in the nozzle for causing fluid displacement in the nozzle, thereby ejecting a droplet of the medication from the opening. The negative pressure of the nozzle and the reservoir are configured in order that the remaining medication is drawn toward the opening to replace the medication dispensed with the droplet.

14 Claims, 11 Drawing Sheets

U.S. PATENT DOCUMENTS

| | | | | |
|---|---|---|---|---|
| 6,129,658 | A | 10/2000 | Delfino et al. | |
| 6,171,232 | B1 | 1/2001 | Papandreou et al. | |
| 6,203,551 | B1 | 3/2001 | Wu | |
| 6,214,115 | B1 | 4/2001 | Taylor et al. | |
| 6,245,104 | B1 | 6/2001 | Alt | |
| 6,268,000 | B1 * | 7/2001 | Romer | 426/115 |
| 6,309,380 | B1 | 10/2001 | Larson et al. | |
| 6,474,786 | B2 * | 11/2002 | Percin et al. | 347/54 |
| 6,645,547 | B1 | 11/2003 | Shekalim et al. | |
| 6,743,462 | B1 | 6/2004 | Pacetti | |
| 6,971,813 | B2 | 12/2005 | Shekalim et al. | |
| 2003/0009133 | A1 * | 1/2003 | Ramey | 604/155 |
| 2004/0050710 | A1 * | 3/2004 | Yan | 205/221 |

* cited by examiner

STENT COATING APPARATUS AND METHOD

CROSS REFERENCE RELATED APPLICATIONS

This application is a continuation of international application number PCT/IL2004/000720, filed 4 Aug. 2004, which claims the priority of U.S. Provisional Application No. 60/491,977, filed 4 Aug. 2003 the contents of all of which are incorporated herein by reference

FIELD AND BACKGROUND OF THE INVENTION

The present invention relates to the coating of medical devices intended for in vivo deployment and, in particular, it concerns a method and device, which is suitable for use in an operating theater just prior to implantation, for selectively applying a medical coating to an implantable medical device, for example a stent.

The practice of coating implantable medical devices with a synthetic or biological active or inactive agent is known. Numerous processes have been proposed for the application of such a coating. Soaking or dipping the implantable device in a bath of liquid medication is suggested by U.S. Pat. No. 5,922,393 to Jayaraman, soaking in an agitated bath, U.S. Pat. No. 6,129,658 to Delfino et al. Devices introducing heat and/or ultrasonic energy in conjunction with the medicated bath are disclosed in U.S. Pat. No. 5,891,507 to Jayaraman and U.S. Pat. No. 6,245,104 B1 to Alt. The device of U.S. Pat. No. 6,214,115 B1 to Taylor et al. suggest spraying the medication by way of pressurized nozzles.

Initially such coating were applied at the time of manufacture. For various reasons such as the short shelf life of some drugs combined with the time span from manufacture to implantation and the possible decision of the medical staff involved concerning the specific drug and dosage to be used based on the patient's at the time of implantation, have lead to methods and devices for applying a coating just prior to implantation. Wrapping the implantable device with medicated conformal film is disclosed in U.S. Pat. No. 6,309,380 B1 to Larson et al. Dipping or soaking in a medicated bath just prior to implantation are suggested in U.S. Pat. No. 5,871,436 to Eury, U.S. Pat. No. 6,106,454 to Berg et al., and U.S. Pat. No. 6,1171,232 B1 to Papandreou et al. U.S. Pat. No. 6,203,551 B1 to Wu provides a bathing chamber for use with specific implantable device such as the stent deployed on the balloon of a catheter (FIG. 1).

Each of the methods and devices intended for use just prior to implantation, listed above, deposit the coating material onto any and all surfaces that are exposed to the coating. This may result in depositing coating material on surfaces on which the coating is unwanted or undesirable. Further, the coating may crack or break away when the implantable device is removed from the implantation apparatus. An example of this would be a stent deployed on a catheter balloon. As the balloon is inflated and the stent is expanded into position, the coating may crack along the interface between the stent and the balloon. These cracks may lead to a breaking away of a portion of the coating from the stent itself. This, in turn, may affect the medicinal effectiveness of the coating, and negatively affect the entire medical procedure.

It is further know to use Ink-Jet technology to apply a liquid to selected portion of a surface. In the paper "Applications of Ink-Jet Printing Technology to BioMEMS and Microfluidic Systems," presented at the SPIC Conference on Microfluidics and BioMEMS, October, 2001, the authors, Patrick Cooley, David Wallace, and Bogdan Antohe provide a fairly detailed description of Ink-Jet technology and the range of its medically related applications (http://www.microfab.com/papers/papers_pdf/spie_biomems.sub.-01_reprint.pdf). A related device is disclosed in U.S. Pat. No. 6,001,311 to Brennan, which uses a moveable two-dimensional array of nozzles to deposit a plurality of different liquid reagents into receiving chambers. In the presentation of Cooley and the device of Brennan, the selective application of the material is based on an objective predetermined location of deposit rather that on a subjective placement as needed to meet the requirements of a specific application procedure. With regard to the application of coatings applied to medical devices with ink-jet applicators, while it is possible to coat only a chosen portion of a device, such as only the stent mounted of a catheter, but not the catheter itself. This type of procedure using current device may, however, require providing complex data files, such as a CAD image of the device to be coated, and insuring that the device be installed in the coating apparatus in a precise manner so as to be oriented exactly the same as the CAD image.

Of most relevance to the present invention is U.S. Pat. No. 6,645,547 to Shekalim, et al., which is incorporated by reference for all purposes as if fully set forth herein. Shekalim, et al. teaches a system and method for selectively applying a coating to an implantable medical device, such as a stent, and thereby avoiding coating the balloon. Shekalim, et al. teaches inserting the stent while mounted on a balloon on a catheter into the device for coating. Since the stent is coated in its compact state after assembly on the balloon, problems of damage to the coating during collapsing of the stent onto the balloon are avoided. The system includes a drop-on-demand inkjet print head, which selectively coats the stent and avoids coating the balloon. The catheter is rotated past the drop-on-demand inkjet print head in order to coat the stent. Due to cost considerations of the system, the print head as well as the other elements of the system are not disposable. A shortcoming of the aforementioned system is that, due to sterility considerations, it is desirable that the elements coming into contact with the stent be disposable. A further shortcoming of the aforementioned system is that the stent is rotated around the print head and therefore the whole catheter needs to be rotated. Therefore, the system needs to be a large "tabletop" system which is typically not portable. If the system were miniaturized sufficiently to be portable, there would be an additional risk of the device being used in the wrong orientation which would compromise operation of the print head and could thus adversely impact the coating quality.

There is therefore a need for a portable stent coating system which avoids pre-expansion of the stent as well as avoids coating the balloon, where the elements coming into contact with the stent are low cost and therefore disposable.

SUMMARY OF THE INVENTION

The present invention is a stent coating system construction and method of operation thereof.

According to the teachings of the present invention there is provided, a stent coating system for coating a stent with a medication, the stent being mounted on a balloon on a catheter, the system comprising an applicator device including: (a) a fluid ejection nozzle having an opening therein configured for dispensing the medication through the opening on to the stent; (b) a reservoir in fluid communication with the nozzle, the reservoir being configured for generating a negative pressure for preventing leakage of the medication from the nozzle via the opening; and (c) a pressure wave actuating arrangement configured for generating a pressure wave in the nozzle, the pressure wave causing fluid displacement in the nozzle, thereby ejecting a droplet of the medication from the opening, the negative pressure of the nozzle and the negative pressure of the reservoir being configured in order that the remaining medication is drawn toward the opening to replace the medication dispensed with the droplet, wherein the reservoir and the nozzle are configured so as to produce an unbroken capillary flow path from the reservoir to the nozzle such that the nozzle is self-priming, and wherein the reservoir is configured to maintain the negative pressure by capillary action so as to be substantially insensitive to changes in orientation of the applicator device.

According to a further feature of the present invention, the nozzle includes a tube with a tapering cross-section, the tapering tube terminating in the opening.

According to a further feature of the present invention, the reservoir includes a flexible capillary tube for storing a majority of the medication.

According to a further feature of the present invention, the reservoir includes a sponge configured for: (a) generating the negative pressure of the reservoir; and (b) storing a majority of the medication.

According to a further feature of the present invention, the reservoir includes a saturation release device configured for squeezing a part of the medication from the sponge.

According to a further feature of the present invention, the pressure wave actuating arrangement includes a piezoelectric collar disposed around at least one of the nozzle and the reservoir.

There is also provided according to the teachings of the present invention, a stent coating system for coating a stent with a medication, the stent having an external surface, the stent being mounted on a balloon on a catheter, the system comprising: (a) an interchangeable cartridge including: (i) an applicator device having: a reservoir configured for storing the medication; and a nozzle in fluid connection with the reservoir, the nozzle being configured for dispensing the medication on to the stent; and (ii) a drive mechanism mechanically connected to the applicator device, the drive mechanism being configured for generating relative motion between the nozzle and the stent in response to an external force; and (b) a reusable drive unit configured for being reversibly connected to the cartridge, the drive unit being configured for providing the external force for actuating the drive mechanism of the cartridge for generating the relative motion between the nozzle and the stent, thereby at least partially coating the external surface of the stent with the medication.

According to a further feature of the present invention, the drive mechanism is configured for moving the nozzle in a helical path around the external surface of the stent.

According to a further feature of the present invention, the drive mechanism includes a toothed gear configured for being driven by the drive unit, the drive unit including a worm gear configured for being reversibly mechanically connected to the toothed gear in order to drive the toothed gear.

According to a further feature of the present invention: (a) the applicator device includes an actuating arrangement configured for ejecting a droplet of the medication from the opening; and (b) the reusable drive unit includes a controller in reversible electric connection to the actuating arrangement, the controller being configured for controlling actuation of the actuating arrangement.

There is also provided according to the teachings of the present invention, a stent coating system for coating a stent with a medication, the stent having an external surface, the stent being mounted on a balloon on a catheter, the system comprising: (a) a nozzle configured for dispensing a plurality of droplets of the medication on to the stent; (b) a clamping mechanism for fastening the catheter therein and thereby preventing movement of the stent; and (c) a drive mechanism mechanically connected to the nozzle, the drive mechanism being configured for moving the nozzle over the external surface of the stent, in order to at least partially coat the external surface of the stent with the medication.

According to a further feature of the present invention, the drive mechanism is configured for moving the nozzle in a helical path around the external surface of the stent.

According to a further feature of the present invention, the drive mechanism includes a screw thread which defines the helical path.

According to a further feature of the present invention, there is also provided: (a) an actuating arrangement configured for ejecting a droplet of the medication from the nozzle; and (b) a controller for controlling actuation of the actuating arrangement, the controller being configured for dispensing the droplets at a dispensing rate, wherein: (i) the drive mechanism is configured, such that: the helical path has a pitch; and the moving of the nozzle in the helical path has a speed; (ii) the nozzle is configured to dispense the droplets at a dispensing volume per droplet; and (iii) the pitch, the speed, the dispensing rate and the dispensing volume are configured such that, the external surface of the stent is completely coated with the medication.

There is also provided according to the teachings of the present invention, a stent coating and checking system for coating a stent with a medication, the stent having an external surface, the stent being mounted on a balloon on a catheter, the system comprising: (a) an applicator device configured for dispensing the medication on to the stent; and (b) a checking device configured for checking the coating of the stent, at least part of the applicator device and at least part of the checking device being permanently mechanically connected, the checking device including: (i) a housing configured for resting the stent therein; (ii) a plurality of electrical contacts disposed in the housing configured for making electrical contact with the external surface of the stent; and (iii) an indicator arrangement configured for: (A) checking the electrical conductivity of the external surface of the stent; and (B) indicating the coating status of the stent.

There is also provided according to the teachings of the present invention, a method for coating a stent with a medication, the stent being mounted on a balloon on a catheter, the method comprising the steps of (a) providing an applicator device for dispensing a plurality of droplets of the medication on to the stent; and (b) applying the droplets with the applicator device around the stent, the droplets being large enough to prevent the balloon from becoming coated with the medication.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a stent coating system and method of operation thereof.

The principles and operation of a stent coating system according to the present invention may be better understood with reference to the drawings and the accompanying description.

Figure 1:
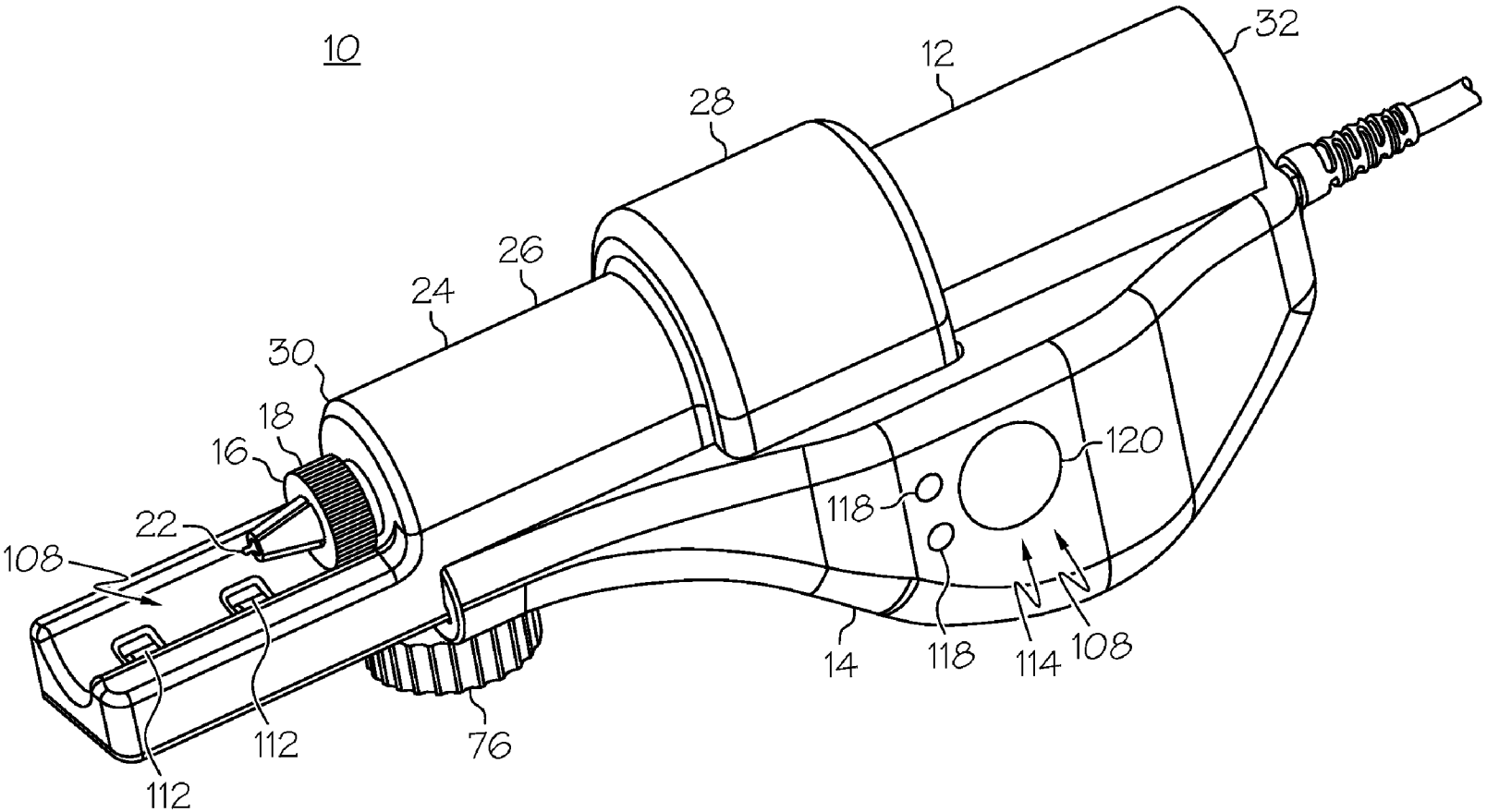
FIG. 1 is an isometric view of a stent coating system that is constructed and operable in accordance with a preferred embodiment of the present invention.
Figure 2:
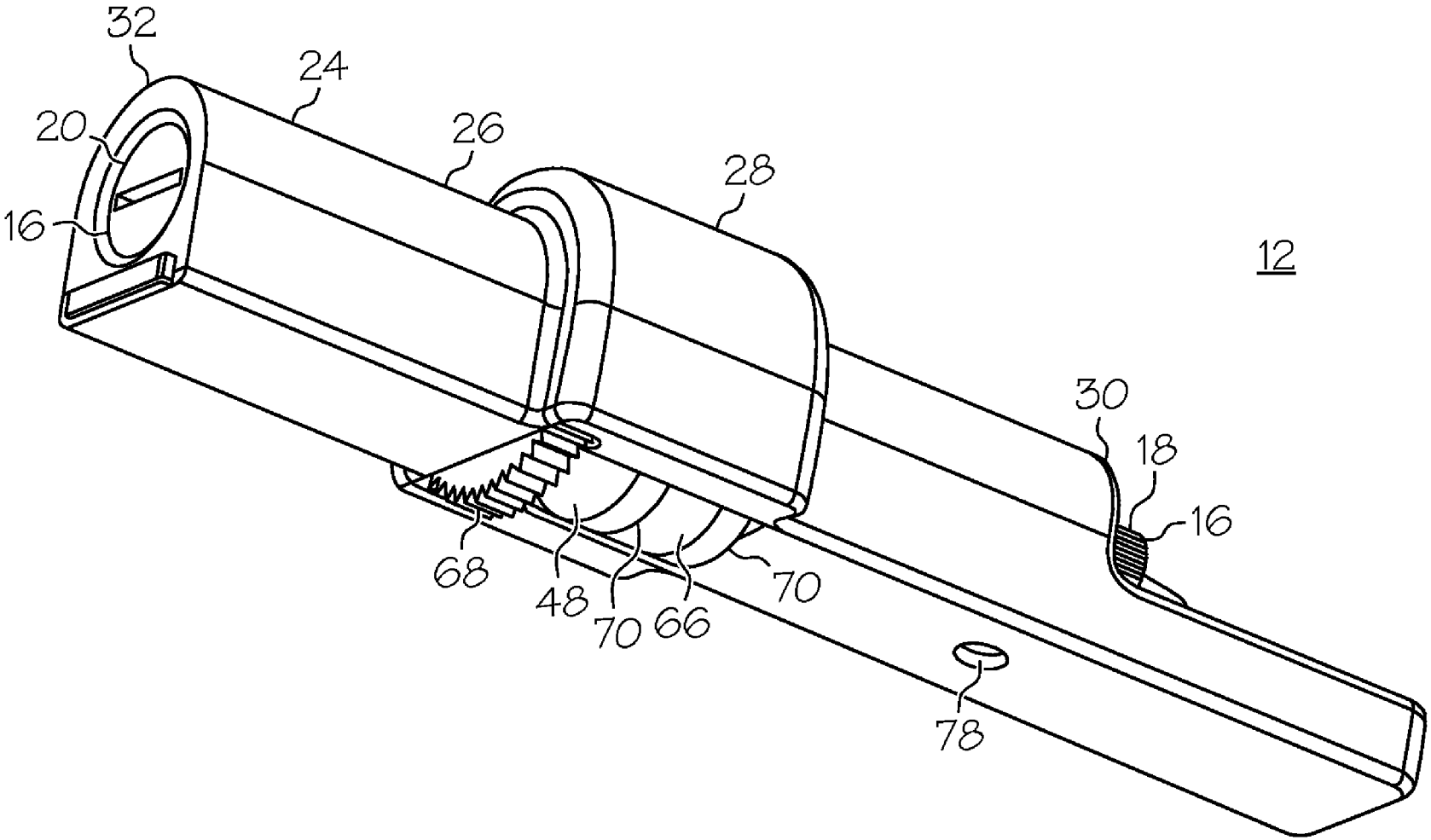
FIG. 2 is an isometric view of a cartridge of the system of FIG. 1, showing the rear and base of the cartridge.
Figure 3:
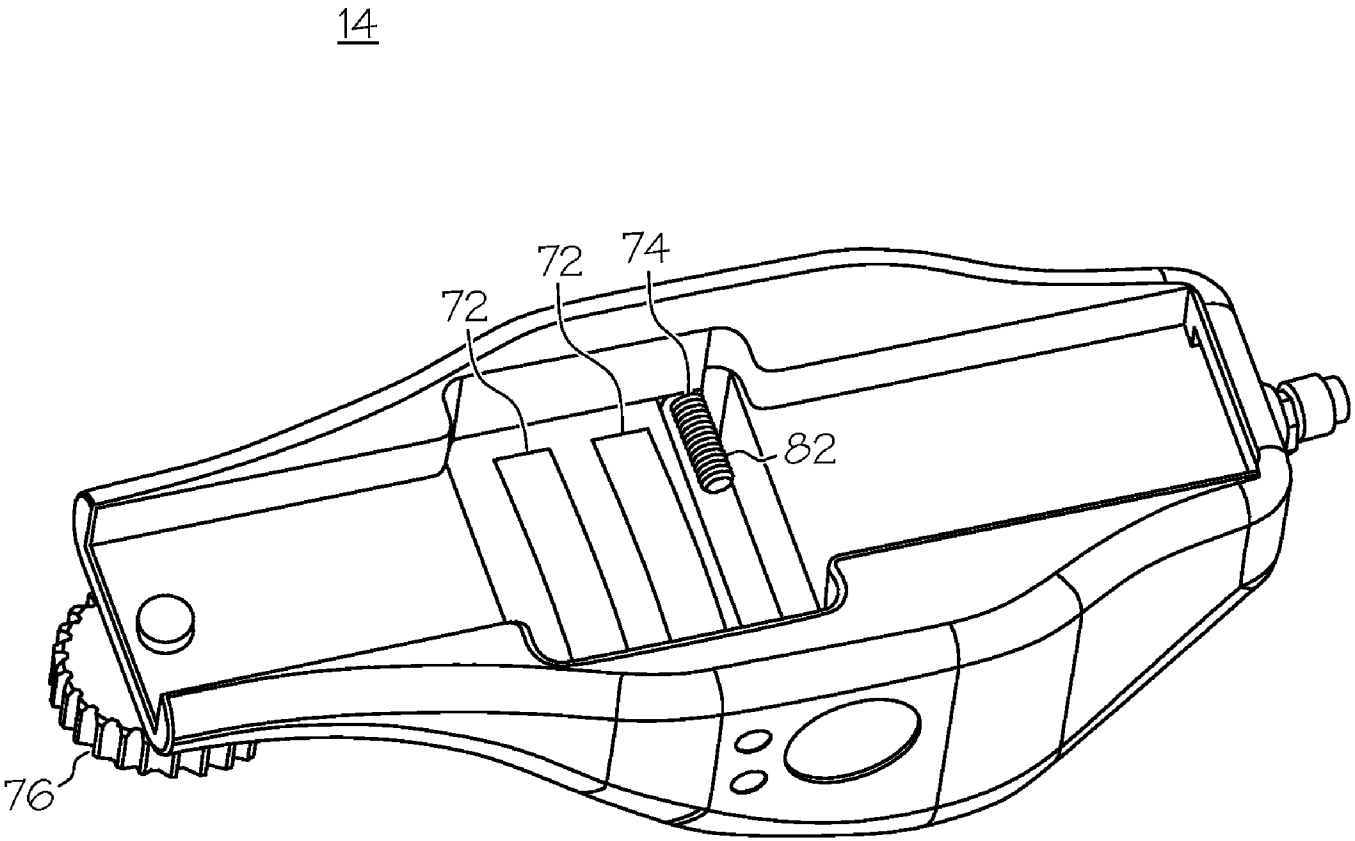
FIG. 3 is an isometric view of a reusable drive unit of the system of FIG. 1.
Figure 4A:
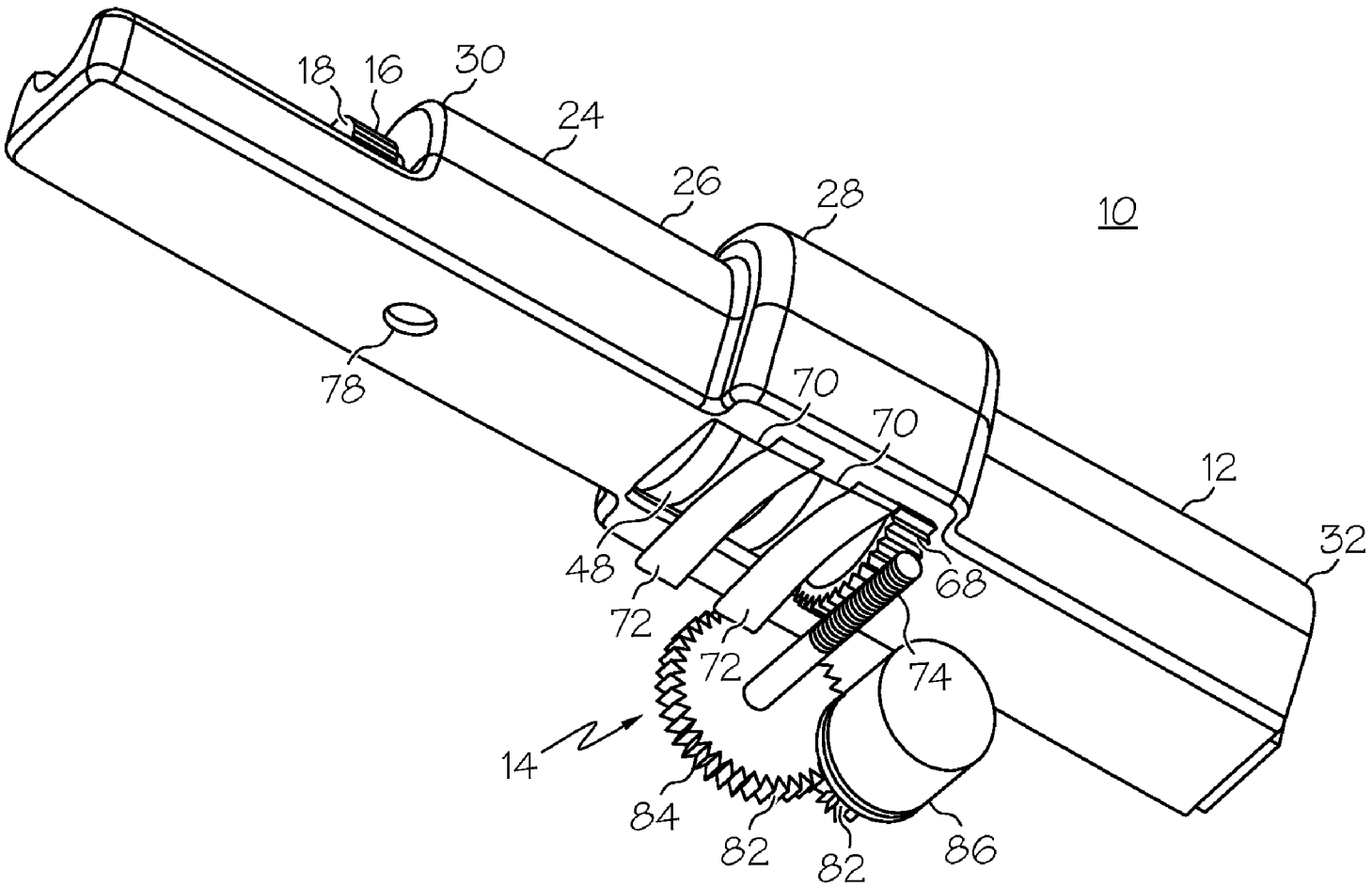
FIG. 4*a* is an isometric view of the system of FIG. 1 having most of the reusable drive unit cut-away for clarity.
Figure 4B:
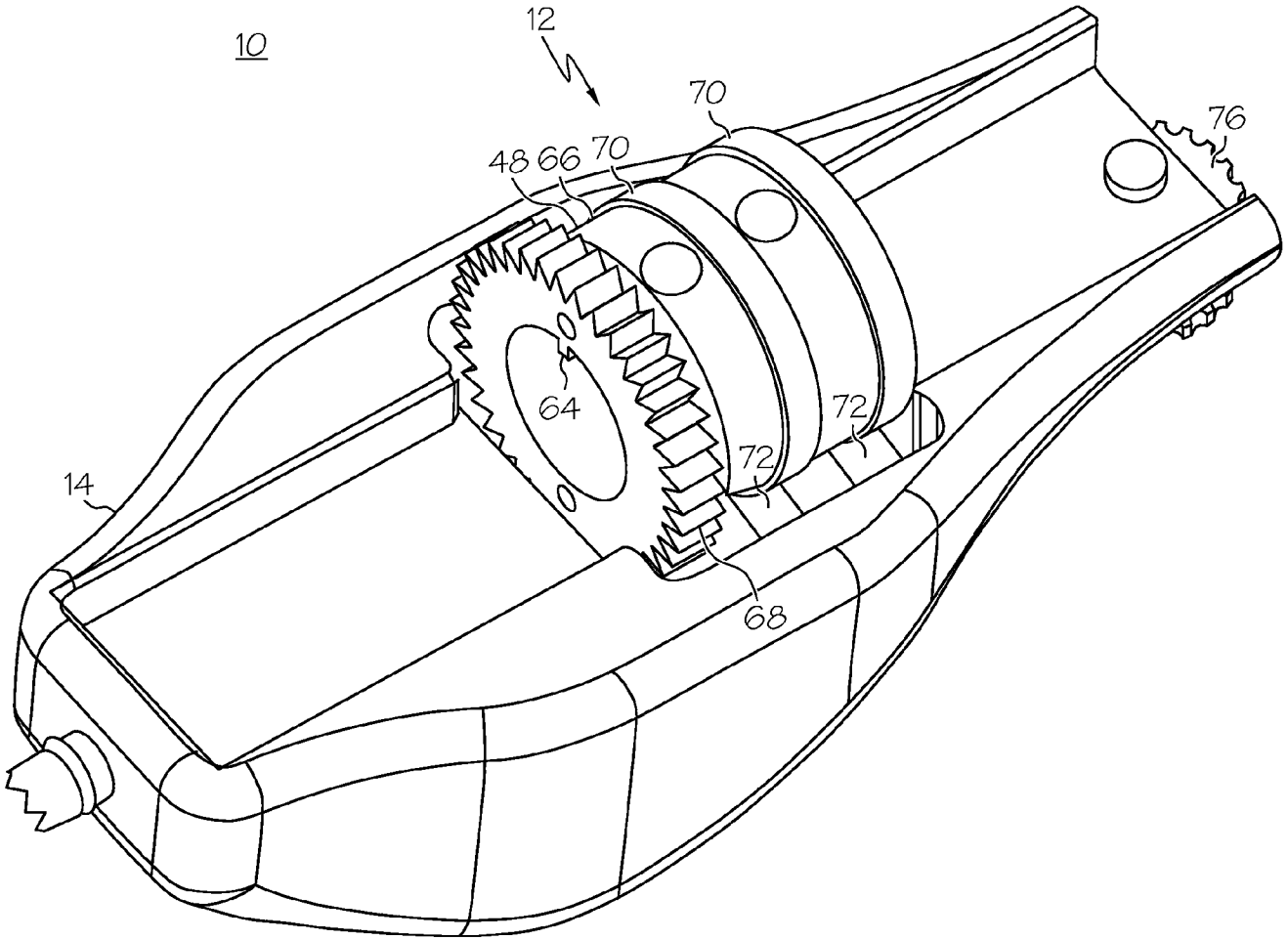
FIG. 4*b* is an isometric view of the system of FIG. 1 having most of the cartridge cut-away for clarity.
Figure 5A:
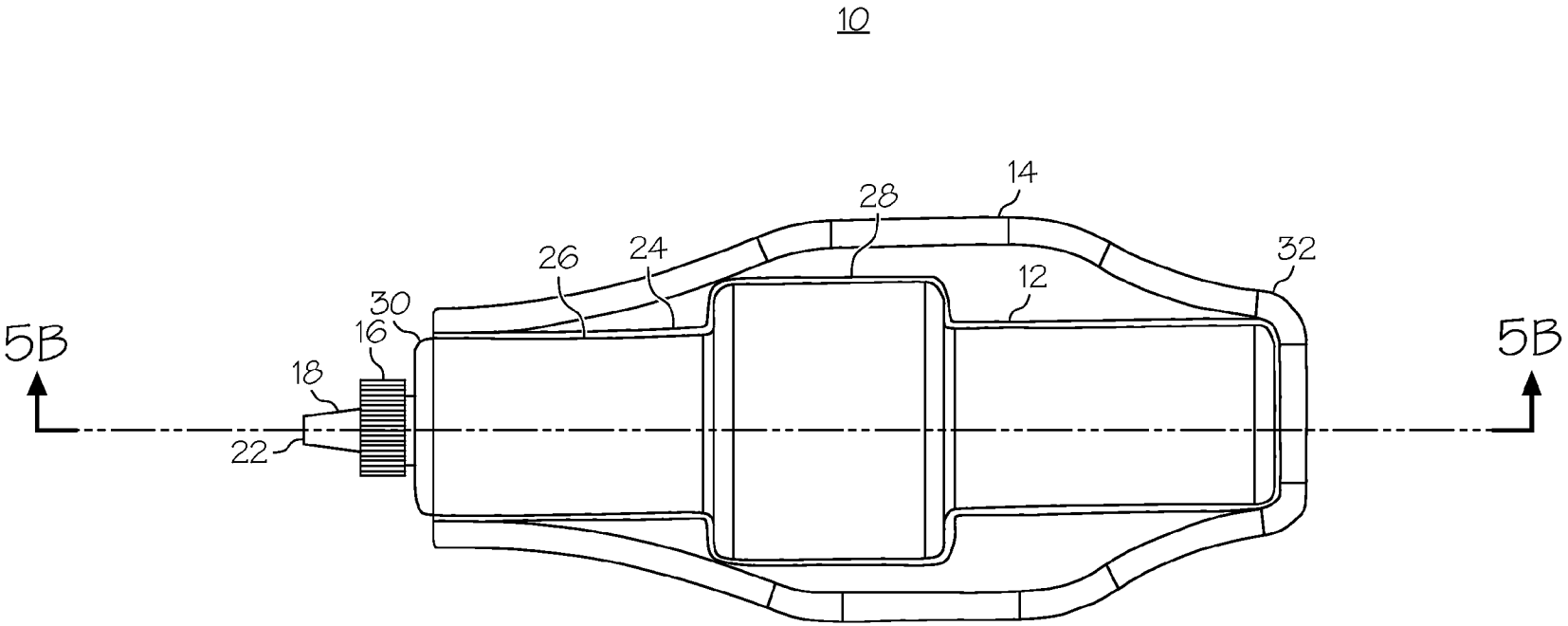
FIG. 5*a* is a plan view of the system of FIG. 1.
Figure 5B:
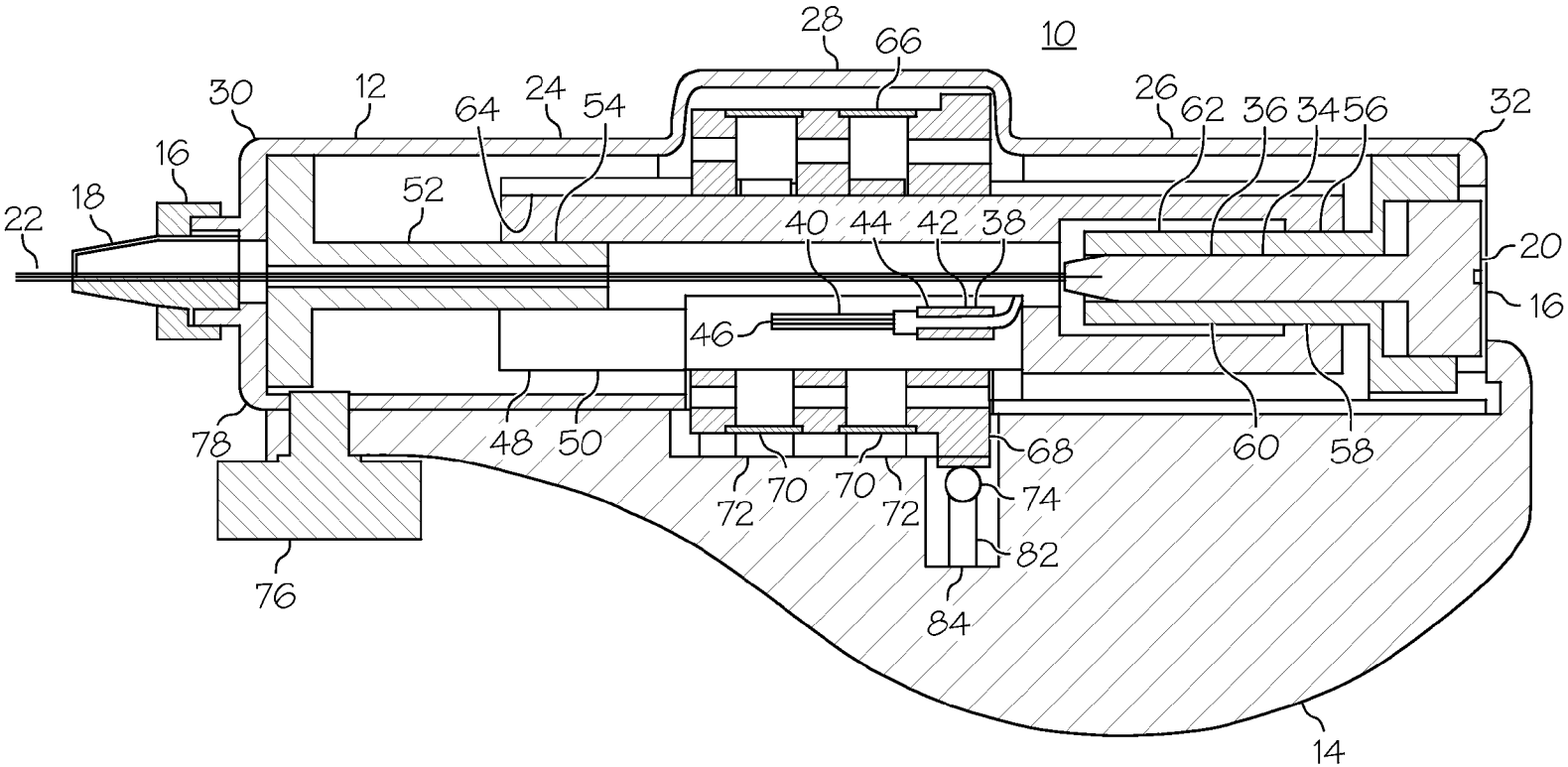
FIG. 5*b* is a cross-sectional view along the line A-A of FIG. 5*a;*
Figure 5C:
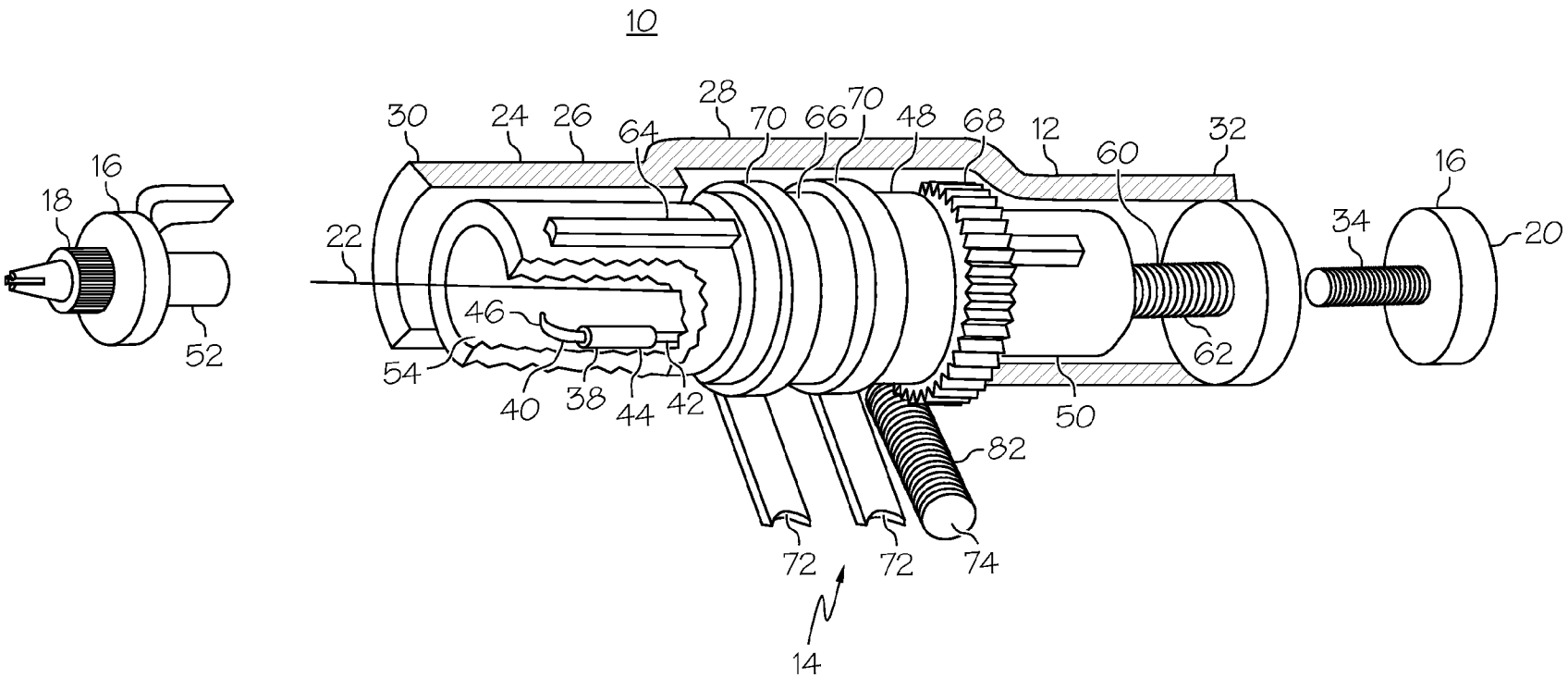
FIG. 5*c* is an exploded cut-away schematic view of the system of FIG. 1.

Reference is now made to FIGS. 1 to 5*c*. FIG. 1 is an isometric view of a stent coating system 10 that is constructed and operable in accordance with a preferred embodiment of the present invention FIG. 2 is an isometric view of a cartridge 12 of system 10 of FIG. 1, showing the rear and base of cartridge 12. FIG. 3 is an isometric view of a reusable drive unit 14 of system 10 of FIG. 1. FIG. 4*a* is an isometric view of system 10 of FIG. 1 having most of reusable drive unit 14 cut-away for clarity. FIG. 4*b* is an isometric view of system 10 of FIG. 1 having most of cartridge 12 cut-away for clarity. FIG. 5*a* is a plan view of system 10 of FIG. 1. FIG. 5*b* is a cross-sectional view along the line A-A of FIG. 5*a*. FIG. 5*c* is an exploded cut-away schematic view of system 10 of FIG. 1. System 10 is a stent coating system for coating a stent (not shown) with a medication. A medication is defined herein to include a fluid substance having preventative and/or healing properties as well as other therapeutic chemical agents. The stent is generally mounted on a balloon (not shown) which is mounted on a catheter (not shown). System 10 includes cartridge 12 and reusable drive unit 14. Cartridge 12 and reusable drive unit 14 are configured for being reversibly connected to each other. Cartridge 12 and reusable drive unit 14 are secured together via a lock screw mechanism 76 having a lock screw disposed in reusable drive unit 14 and a complementary screw thread 78 disposed in cartridge 12.

Cartridge 12 is an interchangeable cartridge. Cartridge 12 is generally designed to be disposed of after having coated a certain number of stents, due to hygiene considerations. Cartridge 12 includes a housing 24 and a clamping mechanism 16. Housing 24 includes a main section 26 having a substantially cylindrical hollow therein, the cylindrical hollow having a centrally located radial projection 28, which is also apparent from the outside of housing 24. Clamping mechanism 16 is configured for fastening the catheter in housing 24 and thereby preventing movement of the stent during coating. Clamping mechanism 16 includes a fastening chuck 18, disposed at an anterior end 30 of main section 26, similar to a chuck of a drill mechanism. Clamping mechanism 16 also includes an adjustable stopper 20, disposed at a posterior end 32 of main section 26, for setting the axial position of the stent inside cartridge 12. Adjustable stopper 20 includes a screw thread 34 which screws into a complementary screw thread 36 of housing 24. Adjustable stopper 20 also has a pin 22, configured as an extension of screw thread 36, which serves as a guide wire for supporting and centering the catheter during coating. The catheter is secured in position by fastening chuck 18.

Cartridge 12 also includes an applicator device 38 having a nozzle 40, a reservoir 42 for storing the medication and an actuating arrangement 44. Nozzle 40 is configured for dispensing a plurality of droplets of the medication on to the stent. Actuating arrangement 44 is configured for ejecting droplets of the medication from an opening 46 of nozzle 40. The desired volume of each droplet depends upon the design of applicator device 38. Applicator device 38 is described in more detail with reference to FIG. 6.

Cartridge 12 also includes a drive mechanism 48. Drive mechanism 48 is preferably configured for moving nozzle 40 in a helical path over the external surface of the stent, in response to an external force generated by reusable drive unit 14, in order to coat the external surface of the stent with the medication. Drive mechanism 48 is now described in more detail. Drive mechanism 48 includes a hollow shaft 50 disposed inside housing 24. Applicator device 38 is disposed in hollow shaft 50 with nozzle 40 being disposed such that, when applicator device 38 is actuated, nozzle 40 ejects the medication over the stent. An inside surface 54 of one end of hollow shaft 50, closest to fastening chuck 18, is supported by a cylindrical protrusion 52 of housing 24. Cylindrical protrusion 52 extends from fastening chuck 18 to inside surface 54. Another inside surface 56 of another end of hollow shaft 50 includes a screw thread 58. Screw thread 58 is screwed on to a complementary screw thread 60 which is disposed on a hollow cylinder 62 extending from posterior end 32 of housing 24. Screw thread 36 of adjustable stopper 20 is disposed on the inside surface of hollow cylinder 62. Therefore, as hollow shaft 50 is turned, hollow shaft 50 and therefore nozzle 40, rotates and translates axially simultaneously within housing 24. Therefore, nozzle 40 moves through a helical path defined by screw thread 58 and screw thread 60. The pitch of the helical path is obviously defined by the pitch of complementary screw threads 58 and 60. Drive mechanism 48 also includes a collar 66. Hollow shaft 50 and collar 66 are formed with a rotation-locking arrangement 64 which allows axial movement of collar 66 relative to shaft 50 but locks them against relative rotation. This rotation-locking arrangement 64 is preferably a simple mechanical engagement arrangement. In the example illustrated here, rotation-locking arrangement 64 includes an elongated groove disposed on the outside surface of hollow shaft 50 parallel to its axis (FIG. 5*b*) and a complementary inward projection from the inner surface of collar 66, as shown in FIG. 4*b*, for engaging the groove. Thus, collar 66 is keyed to hollow shaft 50 via rotation-locking arrangement 64 such that collar 66 transfers rotational motion to hollow shaft 50 without collar 66 having to translate axially with hollow shaft 50. Collar 66 is disposed within radial projection 28 of main section 26 of housing 24. Radial projection 28 preferably includes abutment features deployed to prevent axial movement of collar 66. Collar 66 includes a toothed gear 68, disposed thereon, configured for being driven by a worm gear 74 of reusable drive unit 14, as will be described below. It will be appreciated by those ordinarily skilled in the art that toothed gear 68 may alternatively be implemented using sprockets and other similar mechanical drive members. Collar 66 also includes two electrically conducting contact rings 70. Contact rings 70 are electrically connected to actuating arrangement 44 of applicator device 38. When cartridge 12 is connected to reusable drive unit 14, contact rings 70 make electrical contact with an electric power supply (not shown) of reusable drive unit 14 via two electrical contacts 72 in the upper surface of reusable drive unit 14.

Reusable drive unit 14 includes a motor 86, a gear arrangement 82 and a controller (not shown). Gear arrangement 82 includes a toothed gear 84 and worm gear 74. Motor 86 drives toothed gear 84, which in turn drives worm gear 74. When reusable drive unit 14 and cartridge 12 are connected, worm gear 74 drives toothed gear 68 and thereby moves nozzle 40 in a helical path over the external surface of the stent, thereby coating the external surface of the stent with the medication. The speed of motor 86 sets the speed of nozzle 40 in the helical path. The controller is configured for controlling actuation of actuating arrangement 44 by controlling the frequency and magnitude of the electrical signals supplied to actuating arrangement 44. Therefore, the controller sets the dispensing rate of the droplets of the medication. The pitch of the helical path, the speed of nozzle 40 in the helical path, the volume of each droplet and the dispensing rate of the droplets are configured such that, the external surface of the stent is completely coated with the medication. Additionally, the volume of each droplet is configured, by design considerations of applicator device 38, to be large enough to prevent the balloon from becoming coated with the medication. If the volume of each droplet is too small then the medication may slip between the gaps in the stent and coat the balloon. The desired volume of each droplet depends upon the size of the gaps of the stent being used as well as the viscous properties of the medication. In practice, it has been found that the use of drops having a diameter greater than the width of slots of the stent, and more preferably at least 50% greater than the width of the slots, are generally effective at avoiding significant penetration of medication through the slots directly onto the balloon.

In operation, cartridge 12 is inserted on to reusable drive unit 14. Cartridge 12 and reusable drive unit 14 are then locked together using lock screw mechanism 76. Toothed gear 68 engages with worm gear 74. Adjustable stopper 20 is adjusted if necessary. The stent to be coated, mounted on a balloon on a catheter is mounted on pin 22 until the catheter cannot be inserted any further. Fastening chuck 18 is tightened to secure the catheter. Then motor 86 of reusable drive unit 14 is then activated causing nozzle 40 to make a helical path over the surface of the stent When the coating is finished, signaled by the control box, the stent is removed and used. Another similar stent can be coated immediately if required. When the required stents have been coated, cartridge 12 is disposed of and the reusable unit is ready to be used again.

Figure 6:
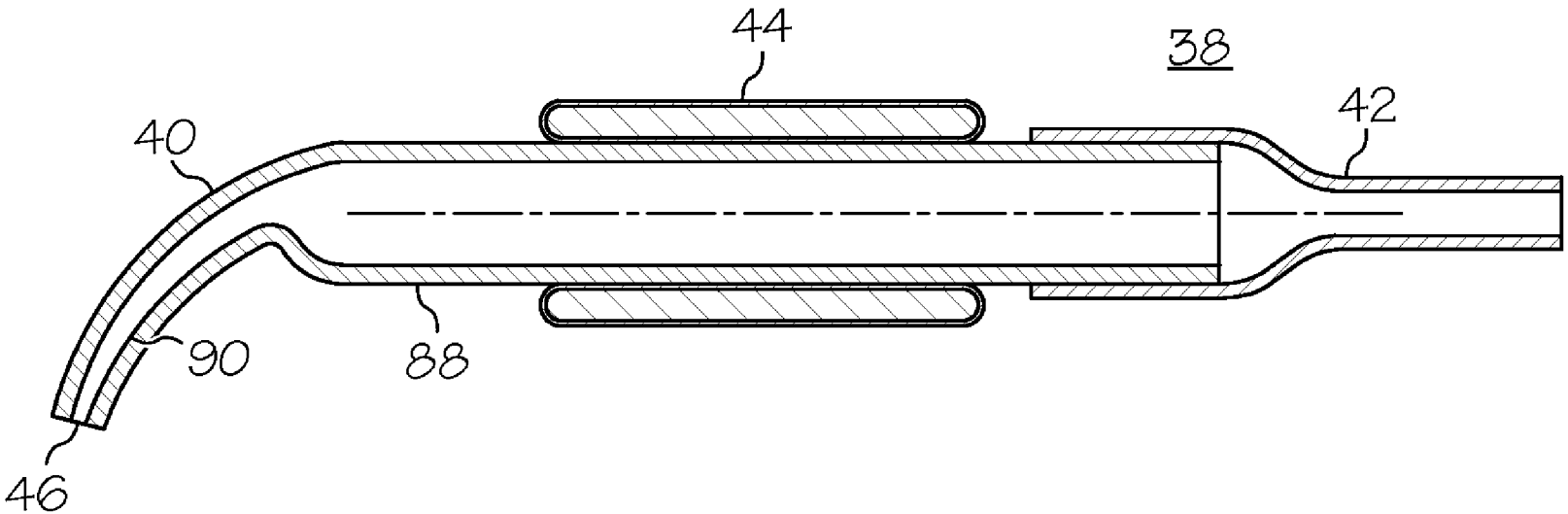
FIG. 6 is a longitudinal cross-section of an applicator device of the cartridge of FIG. 2.

Reference is now made to FIG. 6, which is a longitudinal cross-section of applicator device 38 of cartridge 12 of FIG. 2. By way of introduction to this feature of the present invention, it is a particular feature of most preferred implementations of the present invention that the applicator device 38 provides an unbroken capillary flow path (or multiple such paths) extending through the reservoir 42 to nozzle 40. This capillary path serves two purposes. Firstly, the capillary action of the reservoir provides the negative pressure (i.e. back-pressure or sub-atmospheric pressure) required for proper operation of the drop ejection mechanism of nozzle 40. This ensures the correct operating conditions for applicator device 44 substantially independent of orientation, thereby ensuring that coating quality is not affected by the holding position of the portable coating system of the present invention. Secondly, the unbroken capillary flow path ensures that the medication is drawn from reservoir 42 through to nozzle 40 to perform self-priming of the nozzle. This avoids the wastage of time and expensive medication which would be involved in a conventional nozzle priming procedure.

Parenthetically, in this context, the term "capillary" or "capillary flow path" is used to refer to any flow path within which capillary forces resulting from surface tension interactions with the flow path surfaces overcome gravitational effects to draw up the liquid medication. Theoretically, this property is dependent upon various properties (e.g. surface tension and wetting properties) of the specific liquid being used. In practice, however, a wide range of medications approximate roughly to the properties of water. For the purposes of an unambiguous definition, the claimed capillary properties may be defined in relation to water. The "flow path" referred to herein may be either a well defined path through a conduit or may be provided partially or entirely by internal bulk structure of a porous material such as an open-pore foam or sponge.

Turning now to the specific implementation of applicator device shown in FIG. 6, applicator device 38 includes nozzle 40, reservoir 42 and actuating arrangement 44. Nozzle 40 is typically a fluid ejection nozzle having opening 46 therein configured for dispensing the medication through opening 46 on to the stent Nozzle 40 is similar to an inkjet ejection nozzle for providing a directed jet of droplets. Nozzle 40 includes a glass tube having a non-tapering section 88 and a tapering section 90. Non-tapering section 88 terminates in opening 46. Reservoir 42 is in fluid communication with nozzle 40. Reservoir 42 and nozzle 40 are configured for generating a capillary action, thereby creating a negative pressure with respect to atmospheric pressure, for preventing leakage of the medication from nozzle 40 via opening 46. Reservoir 42 typically includes a flexible capillary tube configured for generating capillary action of reservoir 42 as well as storing most of the medication The flexible capillary tube forms a continuous capillary reservoir. Reservoir 42 is filled by capillary action simply by dipping in the medication and the medication advances through capillary action along the unbroken capillary flow path so as to perform self-priming of nozzle 40. Reservoir 42 then remains filled with the medication due to capillary action which also maintains the required negative pressure.

Actuating arrangement 44 is pressure wave actuating arrangement preferably including a piezoelectric collar. Actuating arrangement 44 is disposed around non-tapering section 88. The ejection of fluid droplets from opening 46 is actuated by pulsing actuating arrangement 44 at a suitable frequency, thus generating a pressure wave in nozzle 40. The pressure wave causes fluid displacement in nozzle 40, thereby ejecting a droplet of the medication from opening 46. The capillary action of nozzle 40 is configured to be greater than the capillary action of reservoir 42 in order that the remaining medication is drawn toward opening 46 in order to replace the medication dispensed with the droplet. Nozzle 40 typically has a length of 15 mm. Non-tapering section 88 has a length of approximately 10 mm. Non-tapering section 88 typically has a diameter of 2 mm. Tapering section 90 is configured to narrow to between 20 and 150 microns at opening 46.

Some of the advantages of applicator device 38 are as follows. First, there are few parts. Second, applicator device 38 is low cost. Third, the negative pressure generated by the capillary action does not depend on gravity, and therefore the device can operate in any orientation. For example, applicator device 38 operates equally well upside down. Fourth, applicator device 38 is self-filling and self-priming with an exact amount of medication. This is important in order to prevent waste of expensive medication.

Figure 7:
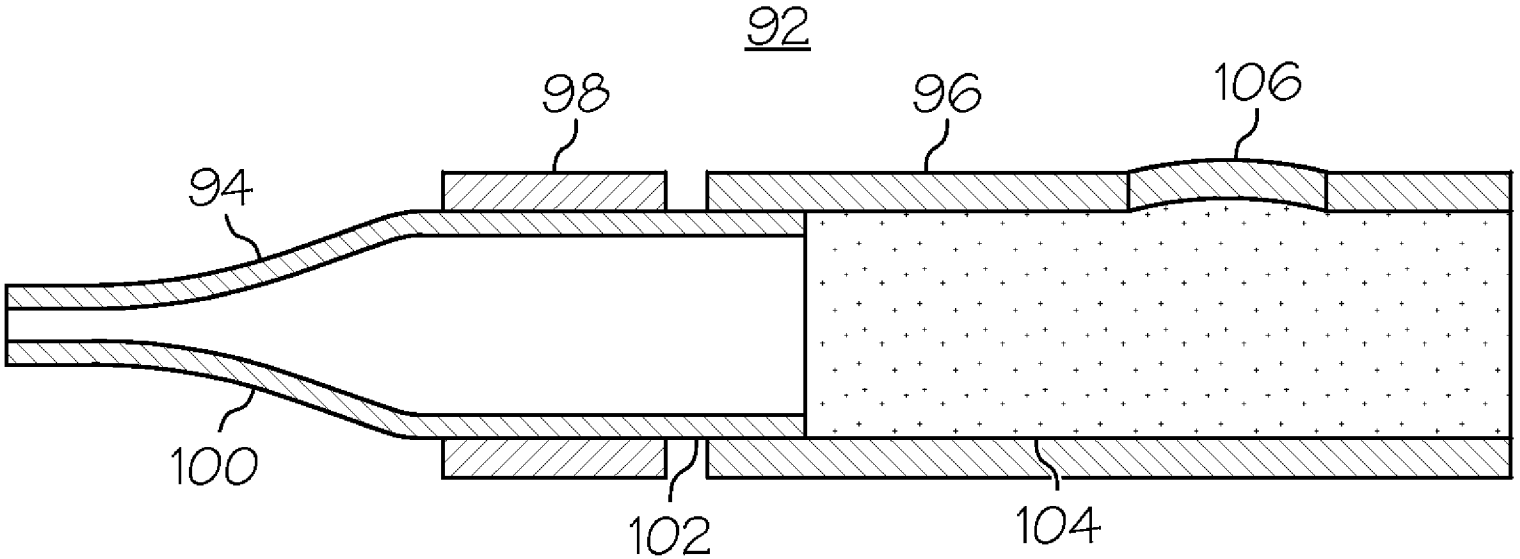
FIG. 7 is a longitudinal cross-section of an applicator device that is constructed and operable in accordance with an alternate embodiment of the present invention.

Reference is now made to FIG. 7, which is a longitudinal cross-section of an applicator device 92 that is constructed and operable in accordance with an alternate embodiment of the present invention. Applicator device 92 includes a nozzle 94, a reservoir 96 and a pressure wave actuator 98. Nozzle 94 and pressure wave actuator 98 are substantially the same as nozzle 40 and actuating arrangement 44 of FIG. 6, respectively. Nozzle 94 includes a glass tube having a tapering section 100 and a non-tapering section 102. Non-tapering section 102 generally has a larger diameter than the glass tube of nozzle 40. Reservoir 96 includes a sponge 104 configured for generating negative pressure as well as storing most of the medication. Applicator device 92 is filled by dipping at least part of sponge 104 in the medication so as to allow sponge 104 to draw up medication by capillary action to as to fill reservoir 96 and perform self-priming of nozzle 94 in the manner described above. It will be noted that at least the portion of sponge 104 inserted into the medication typically carries with it a greater quantity of liquid than is effectively retained by capillary action alone. In order to prevent wastage of the medication and dripping from the nozzle, reservoir 96 preferably includes a saturation release device 106 which includes an elastic button disposed adjacent to sponge 104. Saturation release device 106 is configured for squeezing part of the medication from sponge 104 so that sponge 104 becomes unsaturated, thereby reducing the liquid content so that the capillary action of the sponge is sufficient to retain the remaining liquid and ensure the required negative pressure in reservoir 96. This embodiment has a larger fluid capacity than applicator device 38.

Figure 8:
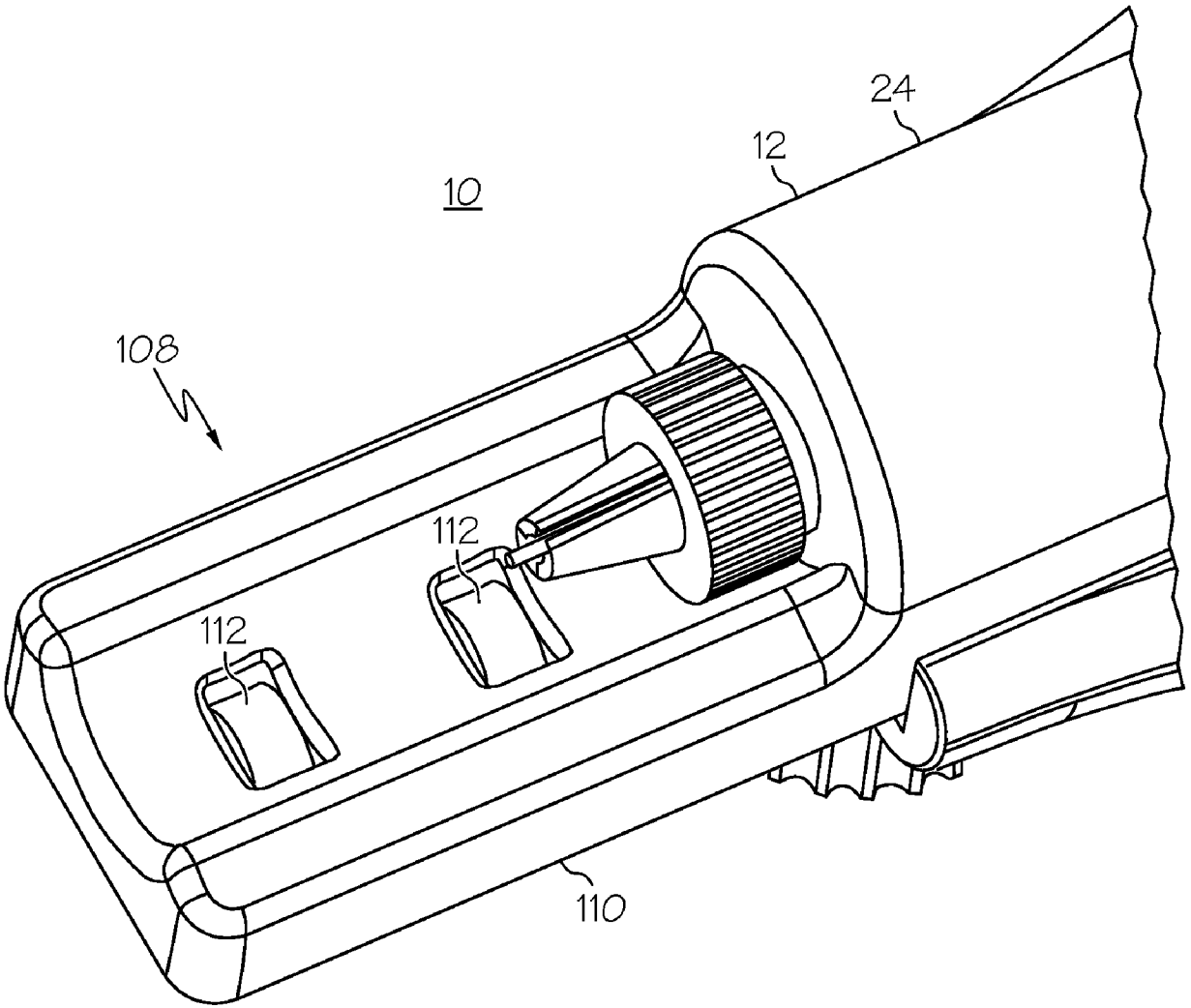
FIG. 8 is an isometric view of a stent coating testing device of the system of FIG. 1.

FIG. 8 is an isometric view of a stent coating testing device 108 of system 10 of FIG. 1. By way of introduction, as a metal stent is electrically conductive prior to be coated with an insulating coating, the present invention includes testing device 108 for testing the stent coating by seeing if the exterior surface of the stent conducts electricity. Testing device 108 includes a housing 110 configured for resting the stent therein. Housing 110 is an extension of housing 24 of cartridge 12. Testing device 108 includes at least two electrical contacts 112 disposed in housing 110. Therefore, housing 110 and electrical contacts 112 are permanently mechanically connected to cartridge 12. The term "permanently mechanically connected" is defined herein to exclude mechanical connection for convenient connection and disconnection. Electrical contacts 112 are configured for making electrical contact with the external surface of the stent. The external surface of the stent is defined herein to include the external surface of an uncoated stent and the external surface of a coated stent where the external surface of the stent includes the coating.

Optionally, a series of three of more electrical contacts may be spaced along housing 110 to test the stent at multiple points along its length. The contacts may be connected in groups with opposite polarity, or a simple electronic switching arrangement may be provided for testing conductivity between different pairs of contacts in turn. Each contact is preferably at least 1 millimeter wide, and typically several millimeters wide. This ensures that the contacts bridge across any slots of the stent to contact the external surface of the stent itself.

Reference is also made to FIG. 1. Testing device 108 includes an indicator arrangement 114, typically including one or more light emitting diodes 118 (LED's) and a test actuating button 120. Indicator arrangement 114 is disposed in reusable drive unit 14. Therefore, indicator arrangement 114 is permanently mechanically connected to reusable drive unit 14. Indicator arrangement 114 is configured for checking the electrical conductivity of the external surface of the stent and indicating the coating status of the stent via light emitting diodes 118. Electrical contacts 112 are electrically connected to indicator arrangement 114 via complementary surface contacts (not shown) on the surfaces of cartridge 12 and reusable drive unit 14.

In operation, the stent is placed over electrical contacts 112 and test actuating button 120 is pressed. The device then checks for conductivity between the electrodes. Light emitting diodes 118 then indicate the coating status of the stent. For example, if high conductivity (low resistance) between the contacts is sensed, a red LED may indicate the absence or incompleteness of the required coating. If low conductivity (high resistance) is sensed, a green LED may indicate successful coating.

In summary, system 10 includes the following advantages. First, a stent is coated in a short time, for example, a coating time of 60 to 100 seconds. Second, system 10 is suitable for all types of balloon-expandable stents. Third, system 10 allows the physician to vary the dosage and type of medication on the spot, by varying the number of layers of coating. Fourth, unlike conventional pre-coating methods, the stent is coated in its collapsed state, thus avoiding the damage often caused to the coating in conventional methods during collapsing of the stent. Fifth, system 10 can be used manually in any orientation. Sixth, sterility of the stent and catheter is maintained at all times.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

What is claimed is:

1. A stent coating system comprising:

a cartridge, the cartridge comprising:

an applicator device to dispense a coating, the applicator device comprising:

(a) a fluid ejection nozzle having an opening, said fluid ejection nozzle being configured to generate a negative pressure;

(b) a reservoir in fluid communication with said fluid ejection nozzle, said reservoir being configured for generating a negative pressure for preventing leakage of the coating from said fluid ejection nozzle via said opening; and (c) a pressure wave actuating arrangement configured for generating a pressure wave in said fluid ejection nozzle, said pressure wave causing fluid displacement in said fluid ejection nozzle, thereby ejecting a droplet of the coating from said opening, said negative pressure of said fluid ejection nozzle and said negative pressure of said reservoir being configured in order that the remaining coating is drawn toward said opening to replace the coating dispensed with said droplet, wherein said reservoir and said fluid ejection nozzle are configured so as to produce an unbroken capillary flow path from said reservoir to said fluid ejection nozzle such that said fluid ejection nozzle is self-priming, wherein said reservoir is configured to maintain said negative pressure by capillary action so as to be substantially insensitive to changes in orientation of said applicator device, and wherein said pressure wave actuating arrangement includes a piezoelectric collar disposed around at least one of said fluid ejection nozzle and said reservoir; and a reusable drive unit, the reusable drive unit being reversibly connected to the cartridge, the reusable drive unit configured to generate a force to move the fluid ejection nozzle.

2. The system of claim 1, wherein said fluid ejection nozzle includes a tube with a tapering cross-section, said tapering tube terminating in said opening.

3. The system of claim 1, wherein said reservoir includes a flexible capillary tube for storing a majority of the coating.

4. The system of claim 1, wherein said reservoir includes a sponge configured for: (a) generating said negative pressure of said reservoir; and (b) storing the coating.

5. The system of claim 4, wherein said reservoir includes a saturation release device configured for squeezing a part of the coating from said sponge.

6. The system of claim 1, the cartridge further comprising:

a drive mechanism, the drive mechanism being mechanically connected to said applicator device, said drive mechanism being configured to move said fluid ejection nozzle in response to the force generated by the reusable drive unit.

7. The system of claim 6, wherein said drive mechanism is configured for moving said fluid ejection nozzle in a helical path.

8. The system of claim 7, wherein said drive mechanism includes a toothed gear, said reusable drive unit including a worm gear reversibly mechanically connected to said toothed gear in order to drive said toothed gear.

9. The system of claim 1, wherein:

said reusable drive unit includes a controller in reversible electric connection to said pressure wave actuating arrangement, said controller being configured for controlling actuation of said pressure wave actuating arrangement.

10. The system of claim 1, further comprising:

(a) a clamping mechanism for preventing movement of a holder for a stent; and (b) a drive mechanism mechanically connected to said fluid ejection nozzle, said drive mechanism being configured for moving said fluid ejection nozzle.

11. The system of claim 10, wherein said drive mechanism is configured for moving said fluid ejection nozzle in a helical path.

12. The system of claim 11, wherein said drive mechanism includes a screw thread which defines said helical path.

13. The system of claim 11, further comprising:

(a) a controller for controlling actuation of said pressure wave actuating arrangement, said controller being configured for dispensing a plurality of droplets at a dispending rate, wherein:

(i) said drive mechanism is configured, such that: said helical path has a pitch; and said moving of said fluid ejection nozzle in said helical path has a speed:

(ii) said fluid ejection nozzle is configured to dispense said plurality of droplets at a dispensing volume per droplet; and (iii) said pitch, said speed, said dispensing rate and said dispensing volume are configured such that the plurality of droplets form a coating on at least a portion of a surface of a stent.

14. The systems of claim 1, further comprising:

(a) a checking device configured for checking a coating status of a stent, at least part of said applicator device and at least part of said checking device being permanently mechanically connected, the checking device including:

(i) a housing configured for resting a stent therein;

(ii) a plurality of electrical contacts disposed in said housing configured for making electrical contact with an external surface of the stent resting in the housing; and (iii) an indicator arrangement configured for: (i) checking an electrical conductivity of the external surface of the stent resting in the housing; and (ii) indicating the coating status of the stent resting in the housing.

* * * * *